US008106592B2

(12) United States Patent
Munters et al.

(10) Patent No.: US 8,106,592 B2
(45) Date of Patent: Jan. 31, 2012

(54) METHOD OF DRIVING A DISCHARGE LAMP, DRIVING ARRANGEMENT, AND PROJECTOR SYSTEM

(75) Inventors: Tom Munters, Hasselt (BE); Pavel Pekarski, Aachen (DE); Carsten Deppe, Aachen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 533 days.

(21) Appl. No.: 12/377,029

(22) PCT Filed: Aug. 7, 2007

(86) PCT No.: PCT/IB2007/053118

§ 371 (c)(1),
(2), (4) Date: Feb. 10, 2009

(87) PCT Pub. No.: WO2008/020366

PCT Pub. Date: Feb. 21, 2008

(65) Prior Publication Data

US 2010/0164383 A1 Jul. 1, 2010

(30) Foreign Application Priority Data

Aug. 15, 2006 (EP) ..... 06118944

(51) Int. Cl.
*H05B 41/36* (2006.01)
*H01J 7/24* (2006.01)

(52) U.S. Cl. ..... 315/117; 315/297

(58) Field of Classification Search ..... 315/117, 315/291, 297, 268, 187
See application file for complete search history.

(56) References Cited

U.S. PATENT DOCUMENTS

| | | | | |
|---|---|---|---|---|
| 7,639,017 | B2 * | 12/2009 | Pekarski | 324/405 |
| 2002/0135324 | A1 | 9/2002 | Fujii et al. | |
| 2006/0012758 | A1 | 1/2006 | Fukano | |
| 2010/0320938 | A1 * | 12/2010 | Pollmann-Retsch et al. | 315/307 |
| 2011/0210680 | A1 * | 9/2011 | Yamamoto et al. | 315/209 R |

FOREIGN PATENT DOCUMENTS

| | | | |
|---|---|---|---|
| WO | 2004054328 | A1 | 6/2004 |
| WO | 20040089044 | A1 | 10/2004 |
| WO | 2006072852 | A1 | 7/2006 |
| WO | 2006072861 | A1 | 7/2006 |
| WO | 2007099477 | A1 | 9/2007 |

* cited by examiner

*Primary Examiner* — Don Le

(57) ABSTRACT

The invention describes a method of driving a discharge lamp (1), wherein a blackening value (N) is determined, which blackening value (N) represents a level of blackening of the interior of the lamp (1), and a recovery parameter (2, T) is calculate based on the blackening value (N). When the lamp power is increased above the saturation power level, the lamp (1) is driven according to the recovery parameter (2, T) for the duration of a specific recovery time. The invention further describes a driving arrangement (70, 70'), and a projector system (10) comprising a high-pressure discharge lamp (1) and such a driving arrangement (70, 70').

12 Claims, 6 Drawing Sheets

METHOD OF DRIVING A DISCHARGE LAMP, DRIVING ARRANGEMENT, AND PROJECTOR SYSTEM

This invention relates to a method of driving a discharge lamp. Furthermore, the invention relates to an appropriate driving arrangement for driving a discharge lamp in a projector system, and to a projector system comprising such a driving arrangement.

Gas discharge lamps, particularly high-pressure gas discharge lamps, comprise an envelope or chamber which consists of material such as quartz glass, capable of withstanding high temperatures. Electrodes made of tungsten protrude into this chamber from opposing sides. The chamber contains a filling consisting of one or more rare gases, and, in the case of a mercury vapour discharge lamp, mainly of mercury. By applying an initial high voltage across the electrodes, a light arc is generated between the tips of the electrodes, which light arc can subsequently be maintained at a lower voltage during operation of the lamp. Owing to their optical properties, high-pressure gas discharge lamps, also called 'burners', are used for applications such as image rendering in projector systems, where images are rendered on a relatively large backdrop for comfortable viewing, for example a home cinema system using a 'beamer'. For such applications, a light source as close as possible to a point light source is required, with as great a luminous intensity as possible, and with a spectral composition closely resembling natural light. These properties can be optimally achieved with high-pressure gas discharge lamps or 'HID lamps' (High Intensity Discharge lamps) and, in particular, with 'UHP lamps' (Ultra High Performance lamps or Ultra High Pressure lamps).

When a high-pressure mercury vapour discharge lamp is being driven at a nominal power level, essentially delivering its rated light output, it is operating above a saturation threshold, above which the mercury in the lamp is present in vapour form. The saturation threshold of a certain type of lamp is governed by many factors such as pressure in the lamp, composition of the fill gas, physical properties of the lamp, and the conditions under which the lamp is being operated. To reduce the light output of the lamp, i.e. to 'dim' the lamp, the power at which the lamp is driven is reduced, for example by reducing the current supply of the lamp. The lamp must be dimmed in order to correctly present darker video sequences, for example a night-time scene in a movie. In state-of-the-art projector systems using such lamps, the range in which the lamp can be dimmed is limited by the fact that, below the saturation threshold, the mercury vapour in the chamber of the lamp condenses, causing the pressure in the lamp to sink. Furthermore, the composition of the fill gas changes, for example by bromine being bound by mercury, with the result that the bromine regenerative cycle, in which tungsten is transported from the fill gas back to the electrodes from which it has evaporated, is interrupted, and the tungsten is deposited on the inside walls of the quartz chamber. This is known as 'blackening', since the tungsten deposits are black, and the lamp appears darker. Blackening takes place after the lamp has been driven in saturated or dimmed mode for a certain length of time.

There are a number of different approaches to dealing with the problem of dimming in such UHP lamps. For example, in WO 2006/072852 A1, lamp voltage and current are continually monitored during a dimmed mode of operation to determine the point at which the lamp power must be increased in order to avoid blackening. Using the voltage and current measurements, the momentary pressure in the lamp can be estimated. Using this information, a driving arrangement of the lamp can determine the point at which the lamp power should be increased above the saturation threshold of the lamp, in order to avoid deposition of tungsten on the chamber walls. In another approach, WO 2006/072861 A1 suggests controlling the relative durations spent in saturated and unsaturated modes so that a significant blackening of the lamp does not take place.

Even though the methods described in the above-mentioned state of the art can successfully avoid lamp blackening from taking place whilst allowing operation of the lamp in a dimmed mode, both approaches must necessarily limit the time during which the lamp can be dimmed. A prolonged dimming of the lamp cannot take place using these methods, since the lamp power is increased after a certain time, regardless of the actual light output required by the film sequence being shown. If the lamp is indeed driven for longer in saturated mode when a prolonged dimmed sequence is required by a movie, the walls of the lamp will be blackened by tungsten deposits. An undesirable side effect of this blackening is that a return to rated power of the lamp will result in an overheating of the walls of the lamp due to the altered thermal absorption properties, so that the quartz re-crystallises. This has the effect that the quartz chamber takes on a 'milky' or 'whitened' appearance, resulting in a marked drop in light output of the lamp. Ultimately, the lifetime of the lamp is drastically shortened. On the other hand, the controlled increase of lamp power to avoid blackening using the above-mentioned state of the art can result in a light output that is too bright for the film sequence being shown, resulting in an unsatisfactory viewing experience and dissatisfaction on the part of the user.

Therefore, an object of the present invention is to provide a method of driving a discharge lamp below a saturation threshold for an extended period of time, while avoiding the problems caused by blackening of the lamp.

To this end, the present invention provides a method of driving a discharge lamp, particularly a high-pressure or ultra-high-pressure discharge lamp, which method comprises determining a blackening value, which blackening value represents a level of blackening of the interior of the lamp. The term 'represents' is intended to mean that the blackening value is related to the level of blackening of the interior of the lamp, i.e. the blackening value gives a direct indication of the degree of blackening of the lamp. The blackening value can be continually adjusted according to the duration of operation of the lamp. A recovery parameter is calculated based on this blackening value, which recovery parameter can also be continually adjusted. When the lamp power is increased above the saturation power level, the lamp is then driven according to the recovery parameter for a specific recovery time. The recovery time for a certain lamp type can be derived, for example, from the blackening value, or can be a predefined value obtained from observations made during tests carried out for that lamp type.

With the method according to the invention, it is possible to drive the lamp in a saturated or dimmed mode for prolonged periods of time, even though blackening arises. It has been shown that any accumulated blackening can be broken down (cleaned) by the bromine regenerative cycle in a mode of operation above the saturation threshold. Therefore, according to the invention, the blackening which accumulates during the dimmed mode of operation is removed or broken down in during a controlled 'recovery' period of operation in which the lamp is driven using the recovery parameter in order to ensure that the lamp does not overheat. By the end of this controlled period, i.e. once the recovery time has elapsed, the blackening will have essentially decomposed or broken down, so that the walls of the lamp are effectively cleaned, and the lamp power can once again be raised to the rated lamp power without any detrimental effect on the lamp. An obvious advantage of the method according to the invention is that a lamp in a projector system can be driven in a saturated mode of operation for particularly long periods of time, for example fifty hours and more, without detrimental effects on the lamp. This was, up until now, not feasible using state of the art methods such as those described in the introduction.

As explained above, a lamp will 'recover' from blackening if an unfavourable increase in temperature in the walls of the lamp is avoided after conclusion of a dimmed phase of operation. In the method according to the invention, the recovery parameter, derived from the blackening value, can be a controlled level of power applied to the lamp, so that the temperature in the lamp is prevented from increasing too rapidly, or the recovery parameter can influence a forced cooling of the lamp, thereby also ensuring that the temperature in the walls of the lamp does not reach a level at which damage to the lamp could arise.

An appropriate driving arrangement for driving a discharge lamp in a projector system comprises a blackening value determination unit for determining a blackening value, which blackening value represents a level of blackening of the interior of the lamp, and a recovery time calculation unit for calculating a recovery time based on the blackening value. The driving arrangement further comprises a control unit for controlling operation of the lamp for a specific recovery time according to the recovery parameter, when the lamp power is increased above the saturation power level. Such a driving arrangement can also comprise a recovery time calculation unit for deriving a recovery time from the blackening value.

The remaining dependent claims and the subsequent description disclose particularly advantageous embodiments and features of the invention.

Any suitable parameter or value can be monitored to arrive at a blackening value. For instance, the level of blackening of a lamp could be estimated by measuring its light output. If a lamp that is being driven in saturated mode exhibits a drop in light output even though the lamp power is being held at a constant power level, it can be assumed that the drop in light output is due to a build-up of tungsten deposits on the inside of the lamp. The extent of light output reduction would then be indicative of the level of blackening in the lamp.

Tests have shown that the blackening is directly related to the length of time at which the lamp was driven in saturated mode. In other words, the longer the lamp was driven in saturated mode, the longer it will need to be driven in an unsaturated mode in order to completely clear the accumulated blackening. The lamp can be driven alternately in saturated and unsaturated modes, changing from one mode back into the other, perhaps for different lengths of time. Therefore, in a particularly preferred embodiment of the invention, the blackening value is based on a saturation time, in which the lamp is driven at a power level below a saturation power level, and on a non-saturation time, in which the lamp is driven at a power level above a saturation power level.

The tests have also shown that recovery is faster than blackening, i.e. the length of time in which the lamp must be driven to decompose the blackening is shorter than the length of time previously spent by the lamp in saturation mode during which the blackening accumulated. Depending on lamp type, decomposition of accumulated blackening can be up to ten times faster than the accumulation itself Therefore, in a preferred embodiment of the invention, the blackening value is based on a net saturation time, which net saturation time is determined by deducting a multiple of the non-saturation time from the saturation time. For a certain type of lamp, this multiple can be, for example, a value between five and ten.

The net saturation time can be directly used as a blackening value, since the level of blackening is directly related to this net saturation time. However, the net saturation time can also be converted into a blackening value by, for example, adjustment by a certain factor, or by adding to it or subtracting from it a certain time value.

As mentioned in the introduction, a lamp can be driven in a saturated mode for a relatively brief period of time without any significant blackening taking place. For example, for a certain lamp type, this period of time might comprise thirty minutes. Only if the lamp is driven for longer in saturated mode will any significant blackening take place. Therefore, in the method according to the invention, an initial 'blackening-free' time for a certain lamp type can be deducted from the net saturation time, for example, a value corresponding to one half hour can be deducted from the blackening value. Alternatively, using a suitable timer, the blackening value might first be computed after an initial predefined time has elapsed when driving the lamp in saturated mode.

To determine a blackening value as a function of the saturated and non-saturated time, as mentioned above, it might be easiest to use a timer. Such a timer would have to be connected to the driving arrangement in some way with information about the momentary power level. However, in a particularly advantageous embodiment of the invention, the blackening value is obtained by simply counting frames of video, since the frame rate for a video projection system is easily determined, and the lamp power is generally adjusted for each frame to give the required light output for that frame. The blackening value might therefore comprise the number of frames for which the lamp power is lower than the saturation threshold, minus a multiple of the number of frames for which the lamp power is greater than the saturation threshold. For example, for every frame for which the lamp power is greater than the saturation threshold, the counter value can be decremented by five. Should the counter reach a certain first threshold value, there is no need to take care of any blackening, since no negligible blackening will remain. On the other hand, if the value of the counter is still above a second threshold value when the lamp power is increased above the saturation threshold, the lamp will be driven according to the recovery parameter for the remaining recovery duration until the counter reaches the second threshold value. The first and the second threshold values are preferably one and the same threshold value. The threshold value can be, for example, a value corresponding to the time for a certain lamp type in which that lamp can be driven in the dimmed mode without any significant blackening taking place, or the threshold value can be zero.

Preferably, a simple up/down counter can be used to record the blackening value. Such a counter can be realised either in software, or directly in hardware, using an arrangement of off-the-counter solid-state circuits. A driving arrangement according to the invention can comprise a suitable counter for counting frames during operation of the lamp to give a blackening value, which counter can be incremented by one for each frame rendered in a saturated mode of operation of the lamp, and decremented by a predefined amount for every frame rendered in a non-saturated mode.

As mentioned above, a return to rated power after a period of operation at a saturated level in which black tungsten deposits have built up on the walls of the lamp can result in a significant increase in temperature in the walls of the bulb, due to absorption in the black coating on the inside of the bulb.

The method according to the invention offers two possible ways of ensuring that the temperature in the lamp is kept below such a critical level.

In a first approach according to the invention, the recovery parameter comprises a value by which the power applied to the lamp is to be maintained below the rated power output of the lamp for the duration of the recovery time. At the outset of the recovery time, the power is at a minimum, while still being above the saturation threshold, and is increased in a controlled manner until the rated or full power level can be applied by the conclusion of the recovery time. Other dimmable components of the projector system can be deployed to provide a fraction of the required dimming, so that the entire dimming need not be provided by the lamp alone. In this way, when the lamp power is suddenly increased, the required light output can be provided by 'un-dimming' these components in a controlled manner and at the same time driving the lamp according to the recovery parameter for the recovery duration.

Alternatively, in a second approach according to the invention, the recovery parameter comprises a value by which the airflow of a cooling arrangement can be increased for the duration of the recovery time. The increased airflow results in an increased cooling of the bulb from the outside, and ensures that the temperature of the bulb walls do not reach a point at which the bulb walls would be irreversibly damaged. The amount by which the air-flow is to be increased will also depend to some extent on the realisation of an already existing cooling arrangement deployed by the projector system, for example on the geometry of cooling slits, the type of cooling fan, the characteristics of air flow within the projector, etc.

Evidently, it would be possible to combine both approaches, i.e. keeping the power to the lamp at a lower level while also applying forced cooling to the lamp using a cooling arrangement.

Because the blackening of the lamp results in higher wall temperatures due to absorption, as explained above, the mercury evaporation during saturation mode will, over time, take place at a higher power level. In other words, the saturation threshold is temporarily raised. Therefore, to accurately determine a net saturation time, this alteration in saturation threshold should be taken into consideration, since a raised saturation threshold will result in an increase in the amount of time which must be allocated to the saturation time, and a decrease in the amount of time which must be allocated to the non-saturation time. Therefore, in a preferred embodiment of the invention, the saturation threshold or saturation power level is adjusted to take into account the altered conditions in the lamp during a prolonged operation in saturation mode. In one approach, the saturation threshold can be determined by continually monitoring voltage and current in the lamp. However, this would require appropriate control circuitry or additional software.

Therefore, in a particularly preferred embodiment of the invention, known values obtained in saturation tests for a certain lamp type can be applied together with the blackening value to obtain a corrected saturation threshold. For example, the net number of frames spent in saturation mode can be adjusted using a predetermined constant value to yield a value by which the saturation threshold should be adjusted. The constant value, obtained in tests, can easily be programmed in the driver unit software so that an adjustment of the saturation threshold can be carried out without having to continually measure voltage and current values in the lamp. By adjusting the saturation threshold in this manner, the duration in which the lamp is actually driven in saturated mode is determined with a high level of accuracy, so that the recovery parameter and the recovery duration are also determined to a high degree of accuracy.

A signal for turning off a projector system, and therefore also its lamp, can be generated while the lamp is still in a dimmed phase, whether inadvertently or deliberately. However, any blackening that has accumulated while the lamp was being operated in dimmed mode will persist. Naturally, it would be advantageous that the blackening value not be lost, so that the blackening that has accumulated on the walls of the lamp can be eliminated when the lamp is turned on again at a later time. Therefore, in a particularly advantageous embodiment of the invention, the blackening value is stored in a non-volatile memory of the driving arrangement, so that the value is 'remembered' even if power is disconnected or the projector system is turned off. The driving arrangement can comprise any suitable kind of non-volatile memory, which may be dedicated to the storage of the blackening value, or may also be used to store other values for other purposes.

Other objects and features of the present invention will become apparent from the following detailed descriptions considered in conjunction with the accompanying drawings. It is to be understood, however, that the drawings are designed solely for the purposes of illustration and not as a definition of the limits of the invention. In the drawings, like reference denote the same objects throughout.

The dimensions of objects in the figures have been chosen for the sake of clarity and do not necessarily reflect the actual relative dimensions.

Figure 1:
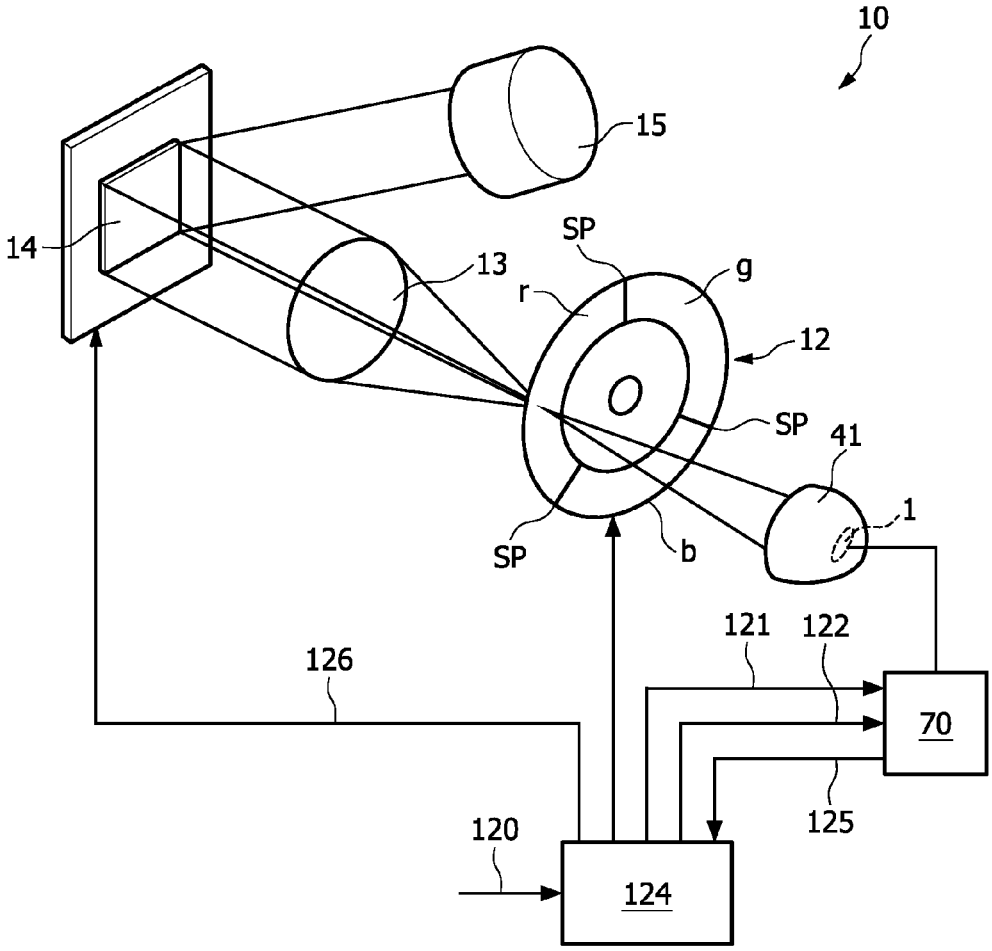
FIG. 1 shows a schematic representation of a projector system according to a first embodiment of the invention.

FIG. 1 shows a basic construction of a projector system 10 using time-sequential colour rendering, in which the different colours in an image—red, green and blue—are rendered one after the other, a process not perceived by the user owing to the reaction time of the eye.

The light of the lamp 1 is focussed within a reflector 11 onto a colour wheel 12 with colour segments red r, green g, and blue b. For the sake of clarity, only three segments r, g, b are shown. Modern colour wheels generally have six segments with the sequence red, green, blue, red, green, blue, and some colour wheels also comprise white segments. Spokes SP, or transition regions, are found between the segments r, g, b. This colour wheel 12 is driven at a certain pace, so that either a red image, a green image, or a blue image is generated. The red, green, or blue light generated according to the position of the colour wheel 12 is then focussed by a collimating lens 13 so that a display unit 14 is evenly illuminated. Here, the display unit 14 is a chip upon which is arranged a number of miniscule moveable mirrors as individual display elements, each of which is associated with an image pixel. The mirrors are illuminated by the light. Each mirror is tilted according to whether the image pixel on the projection area, i.e. the resulting image, is to be bright or dark, so that the light is reflected through a projector lens 15 to the projection area, not shown in the diagram, or away from the projector lens 15 and into an absorber. In this way, the projection area can also be used to some extent as a dimmable component to darken or dim an image being projected. The individual mirrors of the mirror array form a grid with which any image can be generated and with which, for example, video frames can be rendered. Rendering of the different brightness levels in a single frame is effected with the aid of a pulse-width modulation method, in which each display element of the display apparatus is controlled such that light impinges on the corresponding pixel area of the projection area for a certain part of the image duration, and does not impinge on the projection area for the remaining time. An example of such a projector system is the DLP®—System of Texas Instruments®.

Naturally, the invention is not limited to just one kind of projector system, but can be used with any other kind of projector system.

The diagram also shows that the lamp 1 is controlled by a driving arrangement 70, which will be explained later in detail. This driving arrangement 70 is in turn controlled by a video control unit 124. Here, the video control unit 124 manages the synchronisation of the colour wheel 12 and the display unit 14. A signal 120 such as a video signal 120 can be input to the video control unit 124 as shown in this diagram, and a requested target light output level 121 is supplied by the video control unit 124 as a suitable signal to the driving arrangement 70 in advance, so that the lamp power can be adjusted to provide the requested target light output level. The video control unit 124 can also provide frame information in the form of a frame signal 122 to the driving arrangement 70. Furthermore, a suitable signal 125 from the driving arrangement 70 informs the video control unit 124 of the extent to which any other dimmable components of the projector system 10, in this example the display unit 14, are to be deployed. The video control unit 124, with the aid of a suitable control signal 126, can then control the display unit 14.

Figure 2:
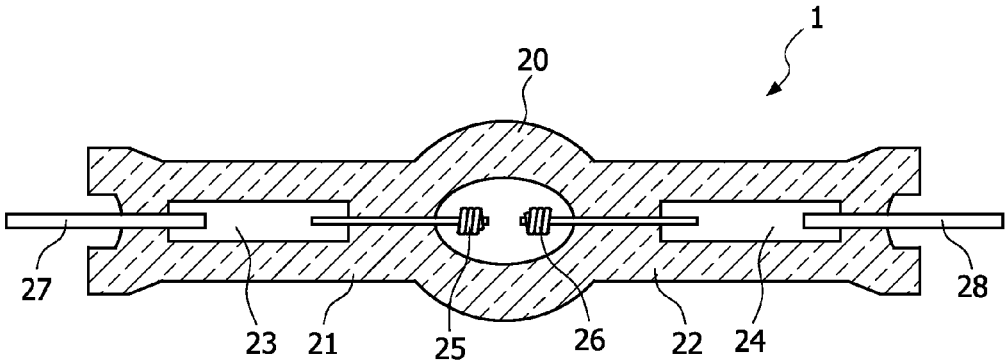
FIG. 2 shows a longitudinal cross-section through a high-pressure mercury vapour discharge lamp.

FIG. 2 shows a high-pressure mercury vapour discharge lamp 1 which can be used in a projector system as described in FIG. 1. The lamp 1 features an elliptical arc tube 20 of quartz glass. The ends of the arc tube 20 are adjoined by cylindrical quartz parts 21, 22, into which molybdenum foils 23, 24 are sealed in a vacuum-tight manner. The inner ends of the molybdenum foils 23, 24 are connected to tungsten electrodes 25, 26 which protrude into the arc tube 20 and carry wrappings or coils of tungsten on the ends which protrude into the bulb. The outer ends of the molybdenum foils 23, 24 are connected to current supply wires 27, 28 which lead to the exterior of the lamp.

The arc tube 20 is filled with rare gas and mercury. Furthermore, a small amount of bromine is also present in the arc tube 20. The principle of operation of such a lamp 1, and particularly the regeneration cycle which, with the aid of bromine addition to the gas, ensures that tungsten does not settle on the inner walls of the arc tube, will be known to a person skilled in the art. That mercury condensing into liquid form also presents a problem to state of the art lamp driving methods, owing to the fact that bromine atoms are bound by liquid mercury, with the result that the regenerative cycle is then interrupted, has already been explained above. The invention is not restricted to the lamp type described here.

Figure 3:
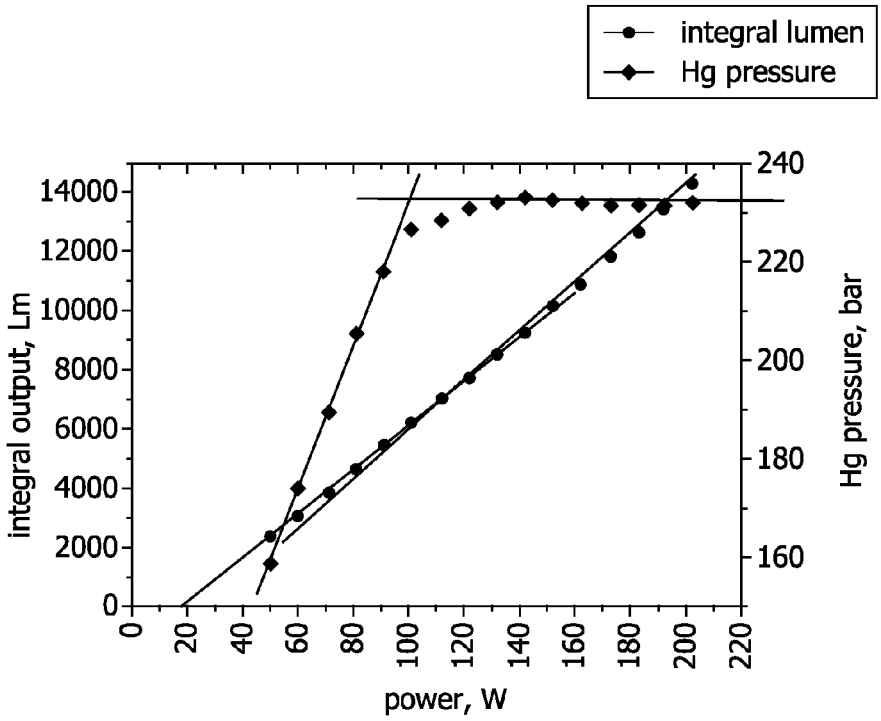
FIG. 3 shows a graph of the integral light output and mercury pressure vs. operational power for 200 W UHP lamp.

FIG. 3 shows the relationship between mercury pressure and operational power for a 200 W UHP lamp. Mercury (Hg) pressure is indicated by the lozenge-shaped markers. It can be seen clearly that, below an operational power of 120 W—the saturation threshold for this lamp—mercury starts to condense. FIG. 3 also shows the relationship between integral light output and the operational power (round markers).

In state of the art methods, reduction of the light output for a UHP lamp is limited to about 30% to ensure that the lamp does not operate in the saturated regime so that blackening does not take place. In the method according to the invention, such a lamp can be driven at power levels well below the saturation threshold, since the ensuing blackening of the lamp will be cleaned in a subsequent recovery phase, as will be shown in the following FIG. 4.

Figure 4:
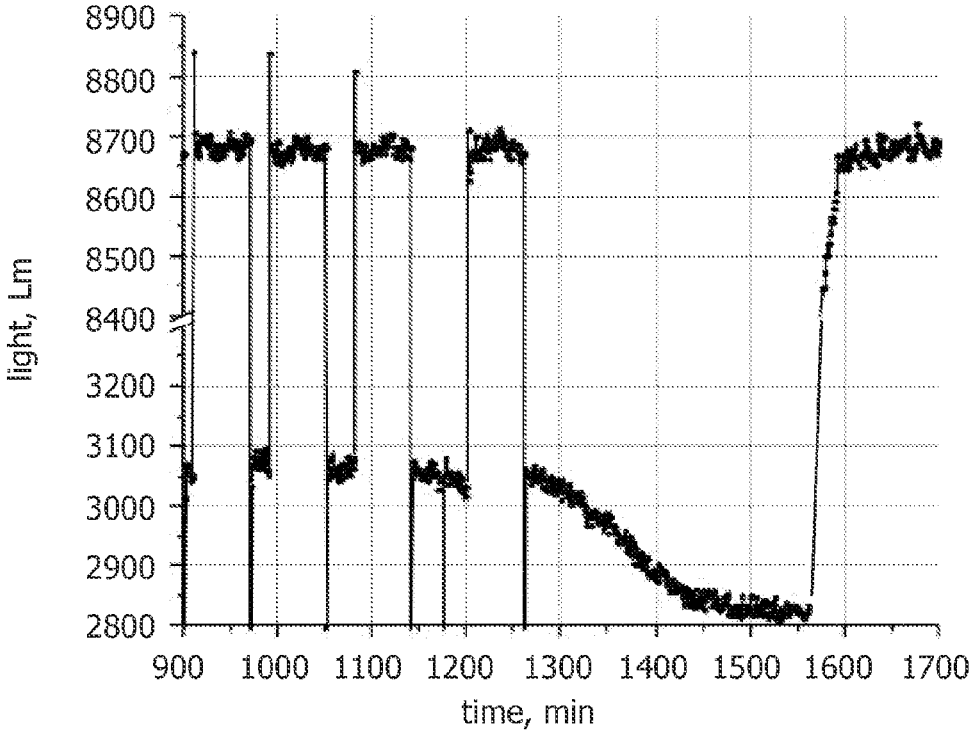
FIG. 4 shows a graph of temperature vs. time for a 132 W UHP lamp as lamp power is raised to bring the lamp out of saturated mode and into unsaturated mode.

FIG. 4 shows a graph of light output vs. time for a 132 W lamp that is being driven alternately above (132 W) and below (60 W) the saturation threshold. In the region between ca. 1260 minutes and 1570 minutes, the light output of the lamp drops significantly owing to the build-up of blackening on the walls of the lamp. At time 1570, the lamp power is raised to a level above the saturation threshold, and the light output steadily increases until the full light output is once more provided, meaning that the blackening has been broken down and the lamp walls have been cleaned.

Figure 5:
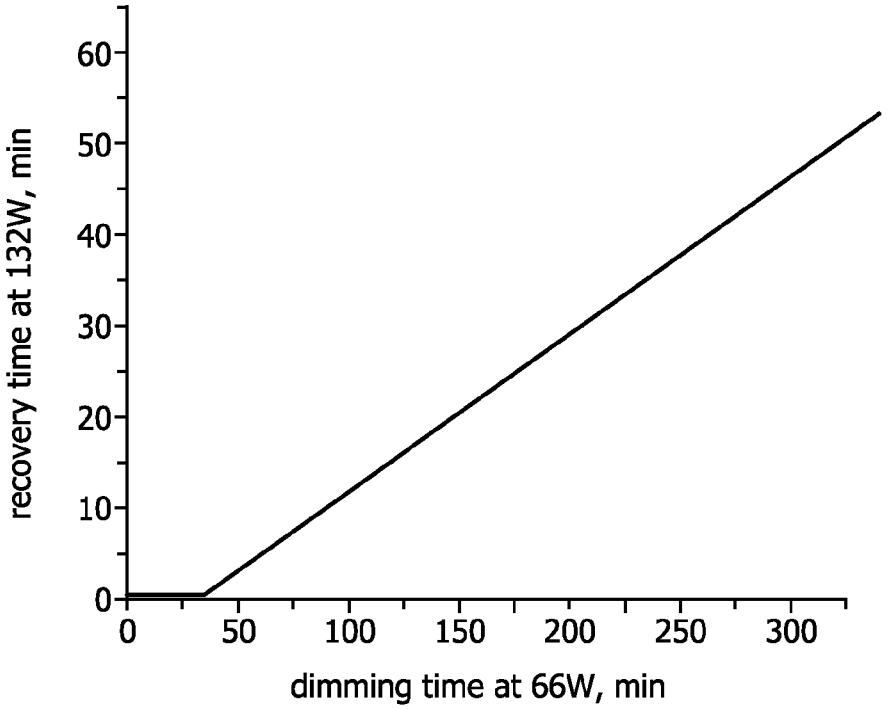
FIG. 5 shows a graph of recovery time vs. time spent in dimming mode for a 132 W UHP lamp.

FIG. 5 shows a graph of recovery time vs. time spent in dimming mode for a 132 W lamp. The graph has been obtained using values observed in a test sequence in which a lamp is driven in saturated mode for a certain length of time, and the time required for breakdown of the blackening ('wall-cleaning') is then measured. The graph shows that the recovery time comprises a fraction of the blackening time, for example a blackening accumulated over 200 minutes is broken down in approximately half an hour of operation at a power level above the saturation threshold.

Figure 6:
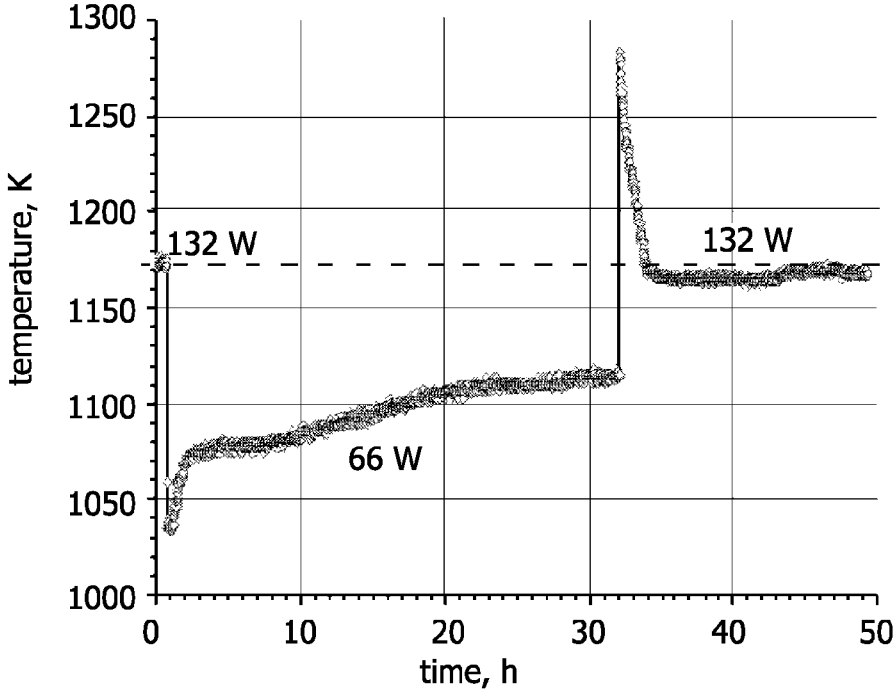
FIG. 6 shows a graph of light output vs. time for a number of dimming cycles for a 132 W UHP lamp.

As mentioned in the description, a sudden return to the rated power level of the lamp after driving the lamp in saturation mode with ensuing blackening will result in a sharp increase in the temperature of the lamp, as shown in FIG. 6. This high temperature generally leads to an undesirable 'whitening' in the walls of the lamp as the quartz recrystallizes, resulting in unsatisfactory light output and a reduction in the lifetime of the lamp.

In the method according to the invention, the temperature of the lamp is prevented from rising to such undesirable levels by driving the lamp according to a recovery parameter—by slowly increasing the lamp power to the rated power level and/or by applying increased forced cooling—for the duration of a specific recovery time. The manner in which the recovery parameter is determined will be explained in detail with the aid of FIG. 7 below.

Figure 7:
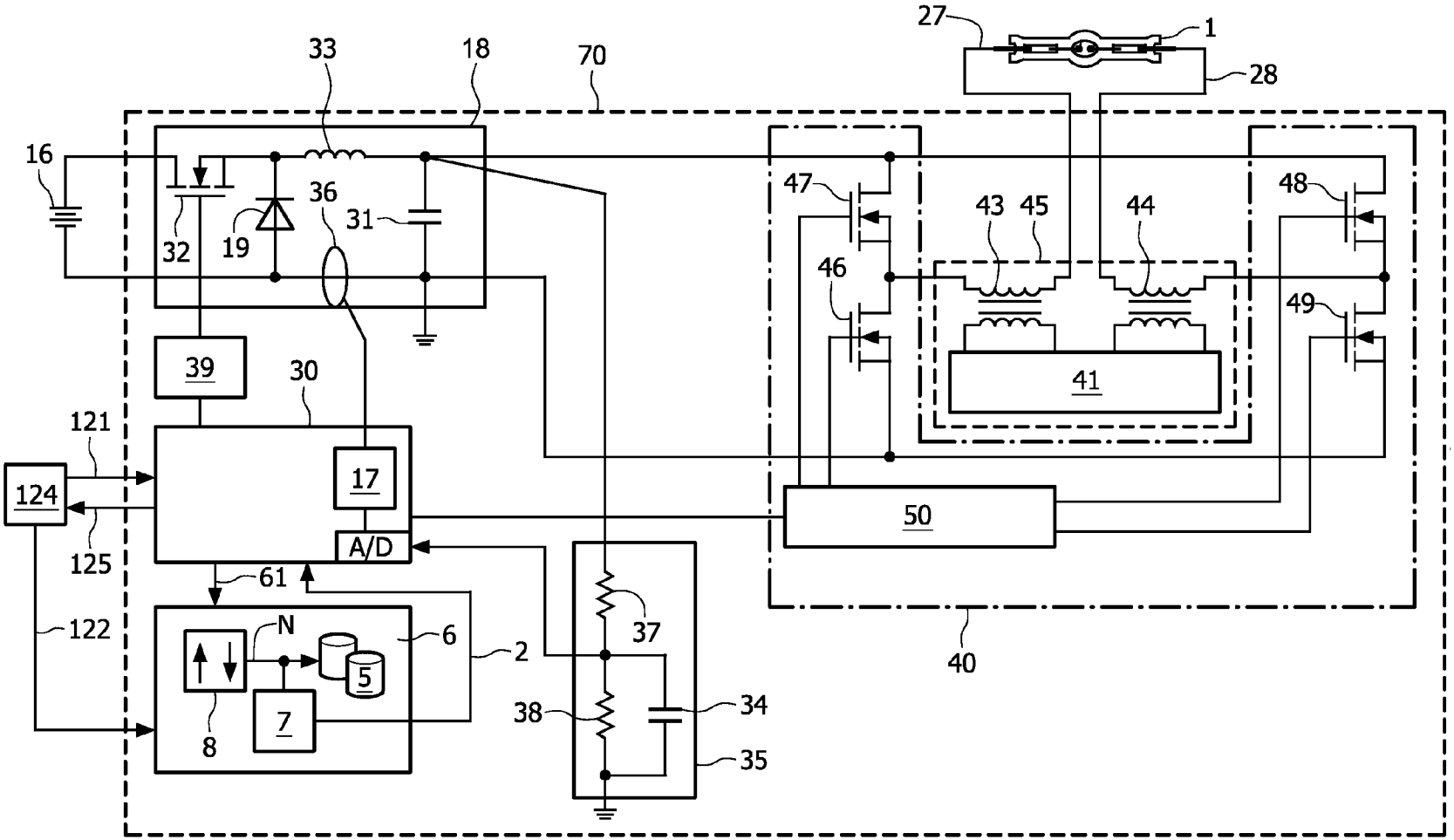
FIG. 7 shows a block diagram of a driving arrangement for a UHP lamp according to the first embodiment of the invention.

FIG. 7 shows an embodiment of a driving arrangement 70 according to the present invention for driving a lamp 1, in this case a 120 W UHP burner 1. The driving arrangement 70 comprises, among others, a direct current converter 18, a commutation stage 40, and an ignition arrangement 45. Only the relevant circuitry has been included in the diagram, for the sake of clarity.

A control circuit 30 controls the converter 18, the commutation stage 40, and the ignition arrangement 45, and monitors the voltage behaviour of the driving arrangement 70 at the lamp 1. The commutation stage 40 comprises a driver 50 which controls four switches 46, 47, 48, 49. The ignition arrangement 45 comprises an ignition controller 41 and an ignition transformer which supplies, with the aid of two chokes 43, 44, a symmetrical high voltage to the supply wires 27, 28 of the lamp 1, so that the lamp 1 can ignite.

The direct current converter 18 is fed by an external direct current supply 16 of, for example, 380V. The direct current converter 18 comprises a switch 32, a diode 19, an inductance 33 and a capacitor 31. The control circuit 30 controls the switch 32 via a level converter 39, and thus also the current in the lamp 1. In this way, the light output of the lamp can be increased or decreased, as specified by the brightness level signal 121 supplied by the video control unit 124.

A voltage-measuring unit 35 is connected in parallel to the capacitor 31, and is realised in the form of a voltage divider with two resistors 37, 38. A capacitor 34 is connected in parallel to the resistor 38. For voltage measurement, a reduced voltage is diverted at the capacitor 31 via the voltage divider 37, 38, and measured in the control circuit 30 by means of an analog/digital converter. The capacitor 34 serves to reduce high-frequency distortion in the measurement signal. The current in the lamp 1 is monitored in the control circuit 30 by means of the current measuring unit 36, which also operates on the principle of induction. Using the measured voltage and current, the control circuit can estimate the momentary lamp pressure, and can thus determine if the lamp is being driven in saturated mode or in unsaturated mode. Furthermore, these measured values could also be used to determine any alteration in the saturation threshold of the lamp. The control unit 30 can output a power level signal 61, which might simply be a Boolean signal with a value of '1' when the lamp 1 is being driven in saturated mode, and '0' when the lamp 1 is being driven in unsaturated mode.

The video control unit 124 provides a frame signal 122 to the driving arrangement 70. In this embodiment of the invention, the number of frames rendered in saturated and unsaturated modes is used to give an indication of the blackening accumulated in the lamp. Using the frame signal 122 and a power level signal 61 from the control unit 30, a blackening value determination unit 6 determines if the lamp is being driven for a particular frame at a power level above or below the saturation threshold. A counter 8 is incremented by one for every frame rendered at a power level below the saturation threshold, and decremented by a certain amount for every frame rendered at a power level above the saturation threshold. Here, the output N of the counter 8 is the blackening value N, which is a direct indication of the accumulated blackening accrued during operation of the lamp. For example, after fifty hours of net operation below the saturation threshold, the blackening value N for a lamp driven at 50 Hz (i.e. 50 frames per second) will be 50·60·60=180,000.

This counter 8 can be set to zero at time of manufacture, and can also attain the value of zero when the lamp is driven for a sufficiently long period above the saturation threshold. Furthermore, the counter 8 can be connected to a non-volatile memory 5, so that the blackening value N is stored in the memory 5 when the lamp is turned off. The driving arrangement 70 might be equipped with some means of recognising when a lamp 1 is replaced, so that in this case the counter 8 would be reset to zero, although it would not in any way be detrimental to a new lamp to be driven for an initial time in the recovery mode.

The blackening value N is forwarded to a recovery parameter calculation unit 7, which then determines a recovery parameter 2. In this embodiment of the invention, the recovery parameter 2 is the power level at which the lamp 1 is to be driven for the recovery time during the recovery mode, and this value is continually adjusted according to the blackening value N.

For example, in the first half hour of operation below the saturation threshold the blackening is assumed to be negligible, so that no adjustment to the lamp power is required when the lamp power is increased from below a saturation threshold to above the saturation threshold. Tests for certain types of UHP lamps have shown that, after prolonged operation below the saturation threshold, the lamp power should initially not be more than 15% below the rated lamp power.

This information yields the following formulae for calculating the adjusted lamp power $P_{nom}$ for a 120 W lamp:

$$P_{nom} = \begin{cases} 120\ \text{W} & \text{if } N < 90000 \\ 120\ \text{W} - (N - 90000)\cdot 2.02\cdot 10^{-6} & \text{if } N \geq 90000 \end{cases}$$

where the factor $2.02\cdot 10^{-6}$ is obtained in lamp tests.

For example, after 50 hours of net operation below the saturation threshold, therefore, the blackening value is $9\cdot 10^6$ (50 frames per second for a duration of 50 hours), and the adjusted lamp power should initially be no higher than (120−18)W=102 W.

Similar formulas can be determined for other lamp types, by observing their behaviour and performing measurements during the product release tests.

The frame counter 8 continues to be decremented during operation above the saturation threshold, at a rate appropriate to the lamp type. In this embodiment, the counter 714 is decremented by 5 for every frame rendered above the saturation threshold. Therefore, after one hour of operation above the saturation threshold, the blackening value has been reduced from $9\cdot 10^6$ to $9\cdot 10^5$, so that the lamp power is now approximately (120−1.64)W=118.4 W. Evidently, the lamp power is continually increased during this time according to the blackening value N, which is also continually being decreased. Eventually, the counter 8 can reach a value of 90,000, after which no blackening needs to be broken down, or can be incremented again if the lamp is once more operated below the saturation threshold.

In this embodiment, the duration of time for which the recovery parameter 2 is applied, i.e. the recovery time, is given by the factor of five, since this experimentally determined value was the rate at which the counter 8 was decremented. In other words, in this example, the recovery time will be a fifth of the net saturation time, or a fifth of the blackening value (after subtraction of the value corresponding to the first half hour), and does not need to be explicitly calculated. Once the counter reaches a value of 90,000, the rated power output of the lamp 1, being 120 W, is no longer adjusted, and the lamp 1 can provide its full light output.

As mentioned above, other dimmable components of the projector system 10 can be deployed to provide a fraction of the required dimming. In this way, when the lamp power is reduced so that the lamp 1 is driven in saturated mode, the other dimmable components, for example, a display unit, can be deployed so that the entire dimming need not be provided by the lamp 1 alone. In this way, when the lamp power is suddenly increased, the dimmable components can be undimmed to provide more brightness, while the lamp 1 itself is first driven for the recovery period according to the recovery parameter. To this end, a signal 125 from the control unit 30 is provided to the video control unit, indicating the level to which the other dimmable components are to be deployed.

Figure 8:
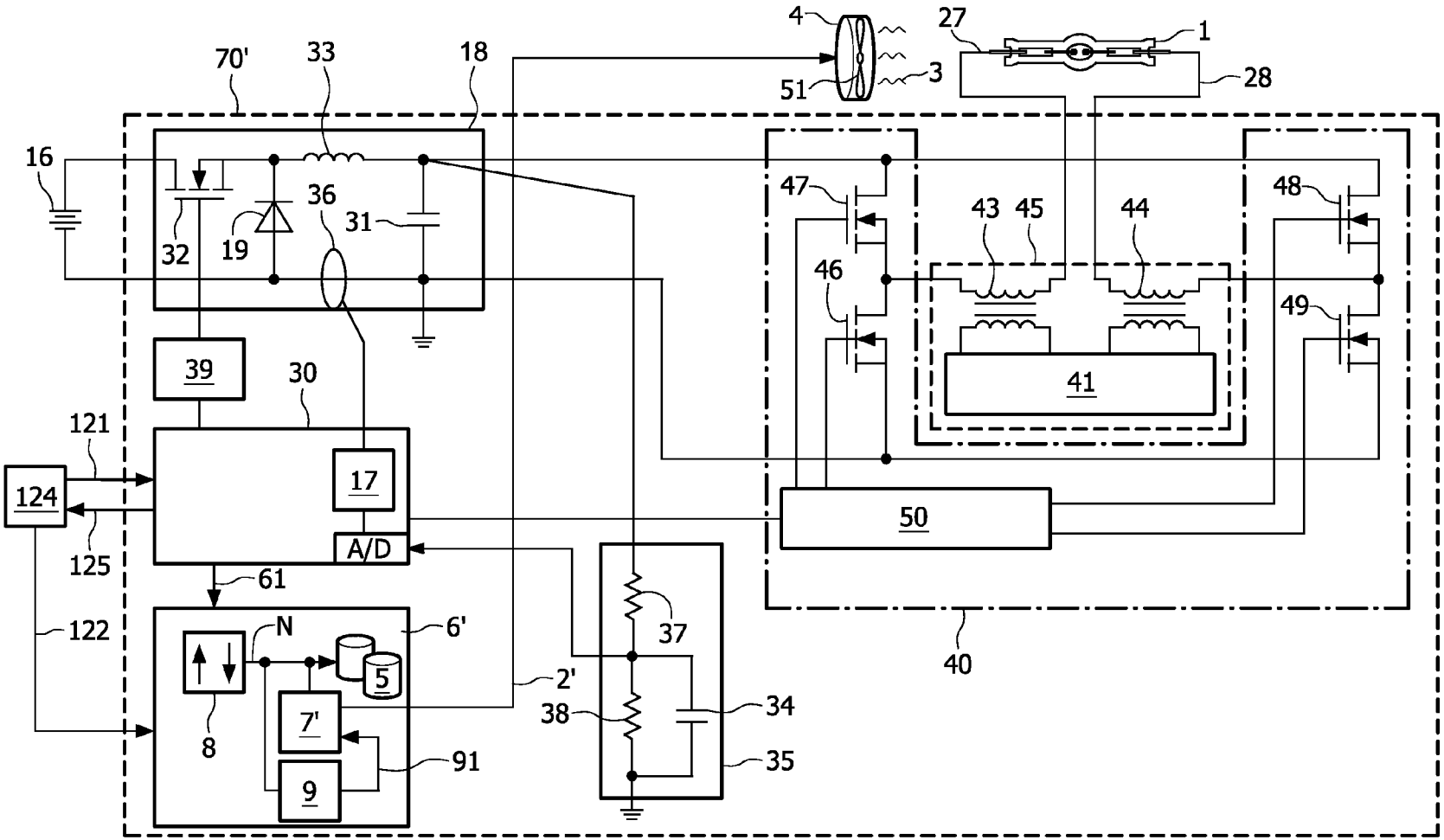
FIG. 8 shows a block diagram of a driving arrangement for a UHP lamp, with a cooling arrangement, according to a second embodiment of the invention.

FIG. 8 shows a driving arrangement 70', in this case with a cooling arrangement 4 comprising a fan 51. A cooling arrangement for a projector system generally ensures that the lamp is continually provided with a cooling airflow, in order to prevent overheating of the lamp and heat-sensitive components of the driving arrangement. In this embodiment of the invention, the air-flow 3 of the cooling arrangement 4 can also be used to ensure that the temperature of the lamp 1 does not reach the detrimentally high levels as shown in FIG. 6 when lamp power is raised to a nominal power level after the lamp 1 has been driven for an extended period of time in saturated mode. As mentioned in the description, the value by which the airflow 3 is increased will depend on the geometry of cooling slits, type of cooling fan, details of airflow within the projector etc.

In this embodiment, a blackening value N corresponding to the net saturation time is determined in the manner described under FIG. 7 above, using the lamp power signal 61 and the frame signal 122. In a recovery parameter calculation block 7' of a blackening value calculation unit 6', the value by which the air flow 3 of the cooling arrangement 4 is to be increased is calculated according to the formula $N \cdot 2 \cdot 10^{-6}$, determined for this lamp type in previous manufacturer test runs. This is output as a suitable recovery parameter 2' to accordingly adjust the airflow 3 output from the cooling arrangement 4. In a recovery time calculation unit 9, the duration for which the airflow adjustment is to be maintained is determined according to the formula $3 \cdot N \cdot 10^{-6}$ minutes, and is forwarded in the form of a suitable control signal 91 to the recovery parameter calculation block 7', so that the recovery parameter calculation block 7' effectively acts as a controller for the cooling arrangement 4.

For example, after a net saturation time of 50 h, N will have a value of $9 \cdot 10^6$, so that the percentage of additional cooling comprises 18%, and the additional cooling is applied for 27 minutes. Tests have shown that the increased cooling can be decreased again if lamp power is reduced once more by at least 10% below the value of the nominal power level, depending on the brightness of the video content to be shown, since any blackening that had previously accumulated will continue to be broken down at this lower power level.

Although the present invention has been disclosed in the form of preferred embodiments and variations thereon, it will be understood that numerous additional modifications and variations could be made thereto without departing from the scope of the invention. For example, a cooling arrangement for use in a projector system according to the invention might be equipped with an additional cooling fan to provide the additional percentage of cooling, which cooling fan is then turned on during the recovery period. In this case the recovery parameter then comprises a Boolean value such as 'On' to indicate that the additional cooling fan is to be turned on, and 'Off' to indicate that the fan is to be deactivated once the recovery period has elapsed.

For the sake of clarity, it is also to be understood that the use of "a" or "an" throughout this application does not exclude a plurality, and "comprising" does not exclude other steps or elements. Also, a "unit" or "module" may comprise a number of blocks or devices, unless explicitly described as a single entity.

The invention claimed is:

1. A method of driving a discharge lamp (1), wherein a blackening value (N) is determined, which blackening value (N) represents a level of blackening of the interior of the lamp (1);

a recovery parameter (2, 2') is calculated based on the blackening value (N);

and, when the lamp power is increased above the saturation power level, the lamp (1) is driven according to the recovery parameter (2, 2') for a specific recovery time.

2. A method according to claim 1, wherein the blackening value (N) is based on a saturation time, in which the lamp (1) is driven at a power level below a saturation power level, and on a non-saturation time, in which the lamp (1) is driven at a power level above a saturation power level.

3. A method according to claim 2, wherein the blackening value (N) is based on a net saturation time, which net saturation time is determined by deducting a multiple of the non-saturation time from the saturation time.

4. A method according to claim 3, wherein the blackening value (N) comprises the number of frames for which the lamp power is lower than the saturation power level, minus a multiple of the number of frames for which the lamp power is greater than the saturation power level.

5. A method according to claim 1, wherein the recovery time is derived from the blackening value (N).

6. A method according to claim 1, wherein the recovery parameter (2, 2') comprises a value by which the power applied to the lamp (1) is to be maintained below the rated power output of the lamp (1) for the duration of the recovery time.

7. A method according to claim 1, wherein the recovery parameter (2, 2') comprises a value by which the airflow (3) of a cooling arrangement (4) is increased for the duration of the recovery time.

8. A method according to claim 1, wherein the saturation power level is adjusted according to the blackening value (N).

9. A method according to claim 1, wherein the blackening value (N) is stored in a non-volatile memory (5).

10. A driving arrangement (70, 70') for driving a discharge lamp (1), which driving arrangement comprises a blackening value determination unit (6, 6') for determining a blackening value (N), which blackening value (N) represents a level of blackening of the interior of the lamp (1);

a recovery parameter calculation unit (7, 7') for calculating a recovery parameter (2, 2') based on the blackening value (N);

and a control unit (30) for controlling operation of the lamp (1) for a specific recovery time according to the recovery parameter (2, 2'), when the lamp power is increased above the saturation power level.

11. A driving arrangement (70, 70') according to claim 10, comprising a counter (8) for counting frames during operation of the lamp (1) to give a blackening value (N).

12. A projector system (10) comprising a high-pressure discharge lamp (1) and a driving arrangement (70, 70') according to claim 10.

* * * * *